United States Patent [19]

Dahlstrom et al.

[11] Patent Number: 4,709,361

[45] Date of Patent: Nov. 24, 1987

[54] FLEXURAL DISK TRANSDUCER

[75] Inventors: David K. Dahlstrom, Los Angeles; Merrill E. Fife, Canyon Country, both of Calif.; Charles R. Judy, Livingston, Tex.

[73] Assignee: Allied Corporation, Morristown, N.J.

[21] Appl. No.: 924,958

[22] Filed: Oct. 30, 1986

[51] Int. Cl.[4] ..... H04R 17/00

[52] U.S. Cl. ..... 367/165; 367/173; 367/160; 310/337

[58] Field of Search ..... 367/157, 158, 160, 162, 367/165, 167, 173, 161; 310/337, 345, 348, 331, 332, 366, 369

[56] References Cited

U.S. PATENT DOCUMENTS

| | | | |
|---|---|---|---|
| 3,249,912 | 5/1966 | Straube | 367/161 |
| 3,255,431 | 6/1966 | Howatt | 367/160 |
| 3,465,178 | 9/1969 | Pardue | 310/366 |
| 3,663,933 | 5/1972 | Madison | 310/331 |
| 4,441,128 | 4/1984 | Ohba et al. | 310/331 |

*Primary Examiner*—Charles T. Jordan
*Assistant Examiner*—John W. Eldred

[57] ABSTRACT

A flexural disk transducer includes two thickness poled piezoelectric disks each of which is bonded on one side to a metal backing plate of substantial thickness and on the other side to a thin metal "skin" or plate. The metal backing plates are, in turn, bonded to a ring-shaped metal spacer member having a rectangular "C" shaped cross section with the axially extending web made sufficiently thin and the radially extending flanges grooved such that the spacer member is sufficiently compliant that it has minimal effect on the resonant frequency of the disks. The disks are coated on each side with a thin layer of conducting material such as silver or copper and have radially extending wires serving as connections to such layers. The entire assembly is contained within a handling ring with the wire connections and the space between the assembly and the handling ring filled with electrical potting material. A thin layer of neoprene rubber covers the exposed faces of the disks for waterproofing.

9 Claims, 3 Drawing Figures

FIG. 2
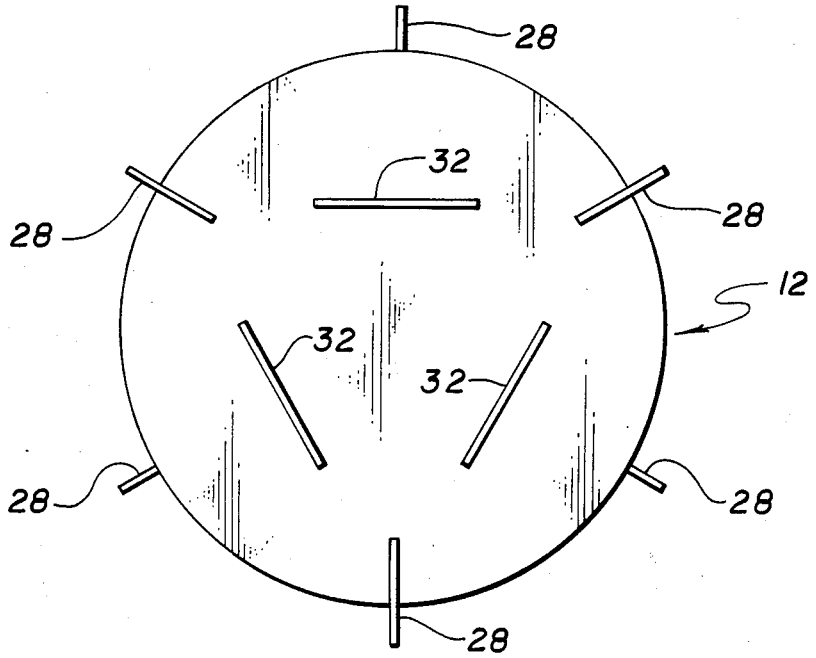
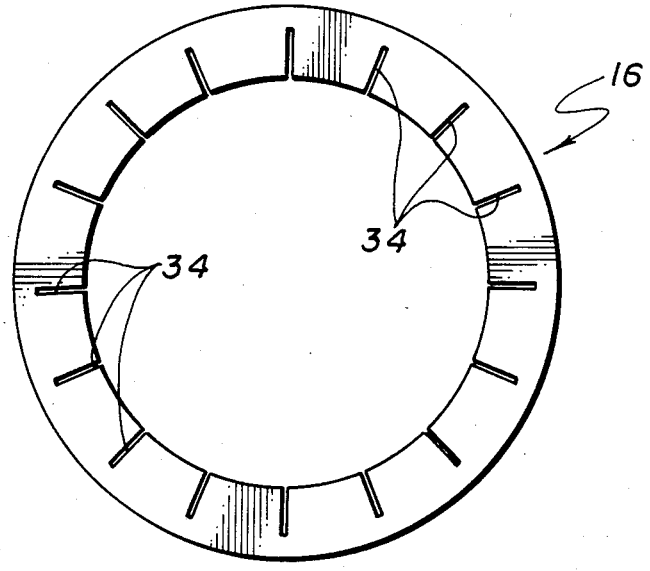
FIG. 3

FLEXURAL DISK TRANSDUCER

This invention relates to an underwater transducer and more particularly to a flexural disk type of transducer used as an acoustic projector and capable of handling a substantial amount of electrical power.

A flexural disk type of underwater transducer has been in existence for many years which includes a pair of ceramic piezoelectric disks of materials such as lead zirconate titanate, each of which is plated on each side with a thin layer of highly conductive material such as silver or copper and which is bonded to a metal backing plate on one side and to a thin metal plate on its opposite side. The disks which are poled in the thickness direction are positioned with the backing plates back to back and spaced from each other by means of an annualar spacer to create an air space. Electrodes connected to opposite sides of the disks are energized electrically to cause flexural movement.

Such transducers are used as projectors to project a substantial amount of energy into the surrounding water. The ambient pressure on the disks varies greatly with the operating depth of the transducer. If the spacer is firmly secured to the backing plates, it will tend to alter the resonant frequency and coupling of the transducer. If the spacer is such that it provides a "simple support" boundary condition at the edges of the disks (i.e. no glue line between the ring and the backing plates), the disks deform as desired when energized and acoustic performance is as expected. However, at shallow depths, high power operation is not possible because inertia forces of the flexing bilaminar disks will exceed the hydrostatic forces which hold the disks against the support ring. Separation occurs which results in signal distortion and loss of acoustic power. Thus it becomes necessary to provide a means of attaching the spacer or spacing ring directly to the disks but without causing the changes in resonant frequency referred to above.

A transducer of the type described is disclosed in U.S. Pat. No. 3,631,383 issued in the name of Gene Zilinskas. Transducers made as described in this patent included rigid spacing rings with large area bonding surfaces. At shallow depths the glue surfaces flex during operation and a psuedo simple support boundary condition exists. However, as the depth is increased the glue stiffens under compressive hydrostatic forces and the projector's resonant frequency shifts upward. This limits the practical operating depth of the projector.

There is, therefore, a need for a flexural disk type of transducer which will not be subject to the power limitations of the above described "simple support" configuration at shallow depths but which is also free of the resonant frequency shifts and coupling problems experienced at great depths where the spacer is bonded to the backing plates over a substantial area.

Applicants have developed a transducer of the type described in which the spacer, although bonded to the backing plates, is so configured that it tends to flex with the bilaminar disk members and therefore imposes a very slight effect on resonant frequency of the transducer at substantial depths but is secured to the disks such that the separation a shallow depths referred to above does not occur. The spacer ring is of a rectangular "C" shaped configuration with the open side toward the center and with the axial web sufficiently thin that it will flex with the disks while being of sufficient strength to prevent collapse or buckling of the spacer at substantial depths. In addition to the foregoing, applicants have devised an arrangement of electrical tabs for carrying energy to the bilaminar disks which minimizes their effect as stress risers in the ceramic material and which also minimizes the possibility of electrical arcing or short circuits between the electrodes connected to opposite sides of the ceramic disks. The transducer is effectively sealed from the surrounding water and is provided with an outer handling ring which provides for mechanical attachment to the transducer and which also acts as a mold for polyurethane potting compound which fills the void between the outer diameter of the transducer element assembly and the inner diameter of the handling ring. To provide waterproofing between the skin and the water, a thin neoprene disk is bonded over each outside flat surface of the transducer. The outer handling ring houses a compact high voltage connector which allows the transducer to be utilized in a modular fashion. This interchangeability provides for minimum repair effort when the transducer is employed in an array configuration. All electrical wiring from the element to the connector is contained within the potting material thus reducing the potential for internal arcing.

In the drawings:

FIG. 2 is a plan view of ceramic disk like that shown in FIG. 1 including electrical connector tabs;

FIG. 3 is a plan view of the center support ring of FIG. 1;

Figure 1:
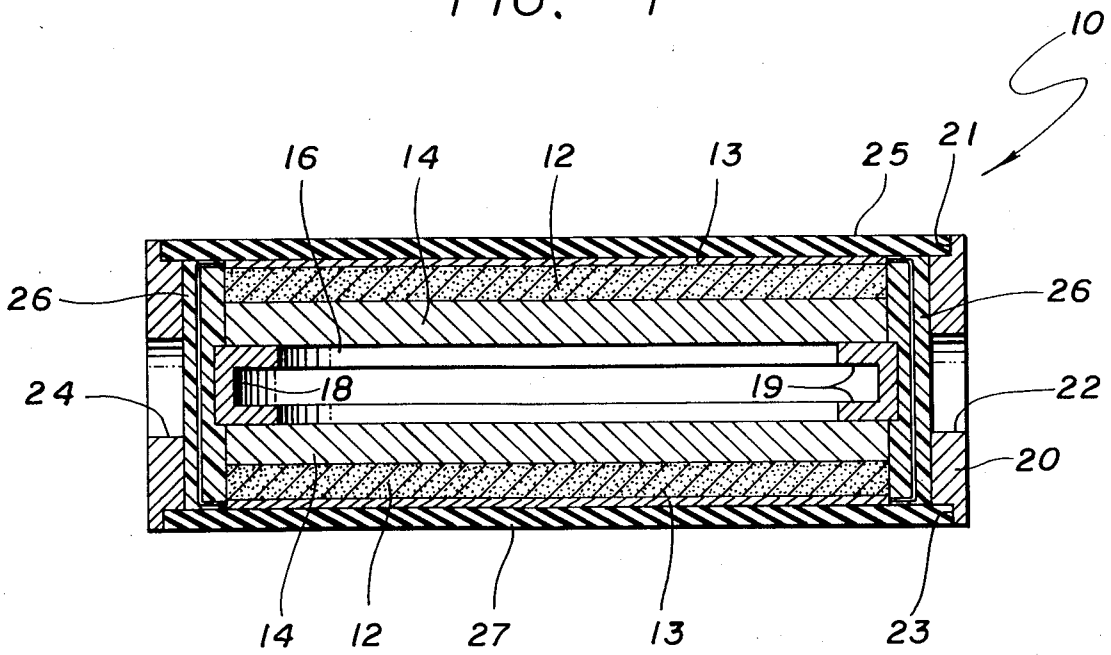
FIG. 1 is a cross-sectional view of a flexural transducer according to our invention.

Referring now to FIG. 1, a projector transducer according to our invention is shown generally at numeral 10 and includes two identical disks 12 of ceramic piezoelectric material such as lead zirconate titanate, each of which includes a facing of a thin metal skin or layer 13 bonded to its exterior face, which layer 13 is described in detail in the above U.S. Pat. No. 3,631,383. Each of disks 12 is backed by means of a metal backing plate 14, such backing plates being arranged back-to-back. Each such backing plate 14 is cemented to a center support ring 16 which is of generally rectangular "C" shaped configuration in which the open side is positioned toward the center, the overall diameter is slightly greater than that of the disks 12 and backing plates 14, and the thickness of the axial web 18 of support ring 16 is chosen such that it will be substantially compliant when the disks 12 are energized. The inwardly directed flanges 19 of center support ring 16 are only of sufficient length as to provide a secure cement bond with the backing plates 14 so that the backing plates will not separate from the support ring 16 under high power output at limited depths.

Radially spaced from center support ring 16, disks 12 and backing plates 14 is an outer handling ring 20 having openings 22 and 24 spaced 180 degrees apart for mounting of electrical connectors, not shown. Carried within ring 20 such that it surrounds and retains the electrical connecting wires from the disks 12 and fills the space between ring 20 and disks 12 and backing plates 14 is a layer of polyurethane potting compound 26. Handling ring 20 is notched at its top and bottom edges as shown at numerals 21 and 23 to receive thin neoprene disks 25 and 27 which are bonded over the entire flat surfaces of the transducer including the thin layer 13, potting compound 26 and notches 21 and 23 to provide waterproofing.

Each of the ceramic disks 12 is plated with a thin layer of silver or copper to provide maximum conductivity across its surfaces and each side of each ceramic disk has fastened thereto a series of electrical connector tabs. Referring to FIG. 2, these tabs are in the form of radially oriented metal strips 28 which are soldered to the plated surfaces of the disks 12 such that they extend beyond the surfaces of the disks and are usable as connectors. The tabs 28 are radially displaced 120 degrees from each other on each face of the disk and those on one side of the disks 12 are displaced sixty degrees from the tabs on the opposite side to minimize the danger of short circuits between tabs from opposite sides of the disk. On one side of each disk 12, between itself and the backing plates 14, a second set of tabs 32 are arranged in a pattern on the surface as shown in FIG. 2. These metal strips may be approximately 0.003 in. thick, 0.25 in. wide and 3 to 4 inches long, more or less, depending upon the diameters of disks 12. Other suitable connector arrangements may be used depending upon requirements.

FIG. 3 is a plan view of the center support ring 16 showing a plurality of slots 34 which are, or may be, cut in the inwardly directed flanges of the center support ring to add to the compliance of the ring. In this instance the number of slots 34 shown are 16, spaces 22½ degrees apart. The slots are cut the entire depth of the flanges to the axial web.

For transducers operating at different frequencies and being of different diameters, the spacing and number of such slots may differ but they are preferably provided in fairly large numbers to enhance the compliance of the center support ring 16. Other modifications may occur to those skilled in the art and within the scope of the appended claims.

We claim:

1. A flexural disk transducer including a pair of piezoelectric ceramic disks poled in the thickness direction and having highly conductive plating layers on the opposite flat surfaces of said disks, metal backing plates of substantial thickness bonded to one side of each of said disks, a thin metal plate bonded to the opposite side of each of said disks, and spacing means positioned between said disks in contact with said backing plates characterized in that said spacing means comprises a center support ring cemented to said backing plates whose outside diameter is substantially the same or slightly greater than the diameter of said disks, said ring having a rectangular "C" shaped cross section open toward its center, the axially extending web of said ring being sufficiently thin to render said ring compliant with movement of said disks.

2. A flexural disk transducer as claimed in claim 1 wherein said transducer includes an outer handling ring of slightly greater diameter than said center support ring and electrical potting means filling the space between the interior surface of said outer handling ring and said center support ring, said disks and said backing plates.

3. A flexural disk transducer as claimed in claim 1 wherein the exposed circular surfaces of said disks are covered with a neoprene waterproofing layer.

4. A flexural disk transducer as claimed in claim 1 wherein said plating layers on one face of each of said disks are connected to electrical connection tabs and the plating layers on the opposite faces of said disks are connected to similar electrical connection tabs which are spaced apart approximately sixty degrees from said first named electrical connection tabs and wherein said transducer includes an outer handling ring of slightly greater diameter than said center support ring and electrical potting means filling the space between the interior surface of said outer handling ring and said center support ring, disks and backing plates and confining and insulating said electrical connection tabs.

5. A flexural disk transducer as claimed in claim 4 wherein the exposed circular surfaces of said disks and the exposed surfaces of said potting layers are covered with a neoprene waterproofing layer.

6. A flexural disk transducer as claimed in claim 5 wherein the inwardly extending flanges of said center support ring include a plurality of radial slots to increase the compliance of said ring with movement of said disks.

7. A flexural disk transducer including a pair of piezoelectric ceramic disks having electrodes on the opposite flat surfaces of said disks, metal backing plates of significant thickness bonded to one side of each of said disks, thin metal plates bonded to the opposite sides of said disks, and spacing means positioned between said disks in contact with said backing plates;

said spacing means comprising a center support ring whose outside diameter is substantially the same as or slightly greater than that of said disks, said ring being of rectangular "C" shaped cross section with the open side facing toward the center, the internally extending flanges of said ring being slotted, said ring flanges being bonded to said backing plates.

8. A flexural disk transducer as claimed in claim 7 wherein said transducer includes an outer handling ring of slightly greater diameter than said center support ring and electrical potting means filling the space between the interior surface of said outer handling ring and said center support ring, said disks and said backing plates.

9. A flexural disk transducer as claimed in claim 8 wherein the exposed circular surfaces of said disks are covered with a neoprene waterproofing layer.

* * * * *